US005769555A

United States Patent [19]

Okada

[11] Patent Number: 5,769,555

[45] Date of Patent: Jun. 23, 1998

[54] CONNECTOR ASSEMBLY

[75] Inventor: Hajime Okada, Yokkaichi, Japan

[73] Assignee: Sumitomo Wiring Systems, Ltd., Japan

[21] Appl. No.: 840,684

[22] Filed: Apr. 29, 1997

Related U.S. Application Data

[63] Continuation of Ser. No. 697,400, Aug. 23, 1996, abandoned, which is a continuation of Ser. No. 337,748, Nov. 14, 1994, abandoned.

[30] Foreign Application Priority Data

Dec. 6, 1993 [JP] Japan ..... 5-071388 U

[51] Int. Cl.[6] ..... H01R 13/64

[52] U.S. Cl. ..... 403/14; 439/378; 439/680

[58] Field of Search ..... 439/680, 681, 439/378; 403/14

[56] References Cited

U.S. PATENT DOCUMENTS

| | | | |
|---|---|---|---|
| 2,089,844 | 8/1937 | Anderson | 439/680 |
| 4,764,129 | 8/1988 | Jones et al. | 439/680 X |
| 5,217,381 | 6/1993 | Zell et al. | 439/680 X |
| 5,288,243 | 2/1994 | Mergless | 439/680 X |

FOREIGN PATENT DOCUMENTS

| | | |
|---|---|---|
| 238801 | 9/1987 | European Pat. Off. . |
| 885 924 | 9/1943 | France . |
| 3234738 | 3/1984 | Germany . |
| 13678 | 1/1983 | Japan . |
| 1400503 | 7/1975 | United Kingdom . |

OTHER PUBLICATIONS

Patent Abstracts of Japan, vol. 17 No. 207 (P–1525); Apr. 22, 1993 JPA–4–347832; Dec. 3, 1992.

*Primary Examiner*—Michael J. Carone
*Assistant Examiner*—Christopher J. Novosad
*Attorney, Agent, or Firm*—Jordan B. Bierman; Bierman, Muserlian and Lucas

[57] ABSTRACT

This invention provides a connector which prevents female and male terminals from coupling partially to each other upon coupling and detaching of female and male connectors. In the assembly, the male connector is provided with a guide rod which projects in a coupling direction. The female connector is provided with a guide hole through which the guide rod passes. Upon coupling of both connectors, the guide rod passes through the guide hole to position an insertion direction. The male terminal enters the female terminal without inclining and partially contacting.

5 Claims, 6 Drawing Sheets

CONNECTOR ASSEMBLY

This application is a continuation of application Ser. No. 08/697,400, filed Aug. 23, 1996, now abandoned, which application is a continuation of application Ser. No. 08/337,748, filed Nov. 14, 1994, now abandoned.

BACKGROUND OF THE INVENTION (1) Field of the Invention

This invention relates to a connector assembly and more particularly to a connector assembly comprising a male connector and a female connector.

(2) Statement of the Prior Art

For convenience of explanation, a conventional connector assembly will be described below by referring to FIG. 13. FIG. 13 is a longitudinal sectional view of the conventional connector assembly.

In the conventional connector assembly, as shown in FIG. 13, a male housing 61 is provided on one side with a male hood 62 in which male terminals 63 project outwardly. On the other hand, female terminals 65 are attached in a mating female housing 64. When both housings 61 and 64 are coupled to each other, the male terminals 63 are fitted in the female terminals 65, respectively. Upon coupling of both housings 61 and 64, they are coupled to each other after they are completely opposed. Accordingly, even if they are being coupled to each other in an inclined posture, their relative insertion direction is gradually corrected by the male hood 62.

However, when a distal end of the male terminal 63 reaches an inlet 66 of the female housing 64, the coupling directions of the male and female terminals 63 and 64 are not coincidental with each other and there a small angle a (FIG. 13) exists between the coupling directions. Consequently, the distal end of the male terminal 63 is inserted into the female terminal 65 while the distal end partially contacts with the insertion port 66 or a coupling aperture of the female terminal 65. The male terminal 63 may be bent by such partial contact.

In the case where coupling and detaching of the male and female terminals under partial contacts are repeated or where coupling and detaching of the male terminal 63 under its partial contact due to its deflection are repeated, the distal end of the male terminal 63 is worn and this results in a failure of an electrical contact between the male and female terminals 63 and 65. In particular, in a connector with a gold-plating layer for enhancing reliability of contact, the gold-plating layer will become worn.

In addition, manual work of fitting an end face of the female housing 64 to the male hood 62 tends to be carried out roughly. When the female housing 64 is forcibly fitted to the hood 62 while the housing 64 is inclined, the end face of the housing 64 pushes slantwise against an opening edge of the male hood 62 and they may be deformed or broken.

SUMMARY OF THE INVENTION

An object of the present invention is to provide a connector assembly which can prevent female and male terminals from being only partially coupled to each other.

Another embodiment of the present invention is to provide a connector assembly which can prevent an end face of a female housing and a male hood from being deformed or broken upon coupling of female and male housings.

In order to achieve the above objects, in a connector assembly of the present invention, one connector is provided with a guide rod projecting in a coupling direction and another connector is provided with guide means for introducing the guide rod. A coupling direction of the female terminal is constrained in an extending direction of the male terminal when the guide means introduces the guide rod so that a distal end of the male terminal contacts with a distal end of the female terminal.

Further, in the connector assembly of the present invention, the guide rod is introduced by the guide means to constrain the coupling directions of the male and female connectors when a distal end of the male hood of the male connector engages with a front end of the female connector.

The guide rod and guide means may be formed into circular or polygonal cross sections.

A plurality of guide rods and means may be provided in the male and female connectors in parallel to each other, respectively.

In the connector assembly of the present invention, upon coupling of the female and male connectors, the projecting guide rod in one connector is fitted to the guide means in the other connector. At that time, the guide rod is introduced by the guide means, the coupling direction of the female terminal is constrained in the extending direction of the male terminal and both connectors are corrected so that they are completely opposed. When the distal end of the male terminal is to be inserted in the insertion port of the female housing, both connectors are constrained to be opposed in correct alignment. Thus, the male terminal is inserted in the coupling direction in the female housing without any partial contact of the male terminal.

In addition, when the front face of the female connector engages with the distal end of the male hood of the male connector, the guide rod is introduced by the guide means to constrain the coupling direction. Consequently, even if both connectors are to be interconnected in their positions twisted with respect to the coupling direction, an opening edge of the male hood contacts with a front end face of the male connector. Thus, the end face of the female housing and to opening edge of the male hood are not deformed or broken.

As described above, according to the present invention, when the distal end of the male terminal reaches the insertion port of the female housing, the coupling direction of the female terminal is constrained in the extending direction of the male terminal. Accordingly, it is possible to prevent the terminals from being worn due to the partial contact of the terminals and to enhance reliability of the connector assembly for a long period of time.

In addition to the above effect, since the coupling directions of both connectors are restricted when the front end face of the female connector engages with the distal end of the male hood, it is possible to prevent the distal end of the male hood and the female housing from being broken.

DETAILED DESCRIPTION OF THE PREFERRED EMBODIMENTS

Referring now to FIGS. 1 through 9, embodiments of a connector assembly of the present invention, which are applied to a two pole waterproof connector assembly, will be explained below.

Figure 1:
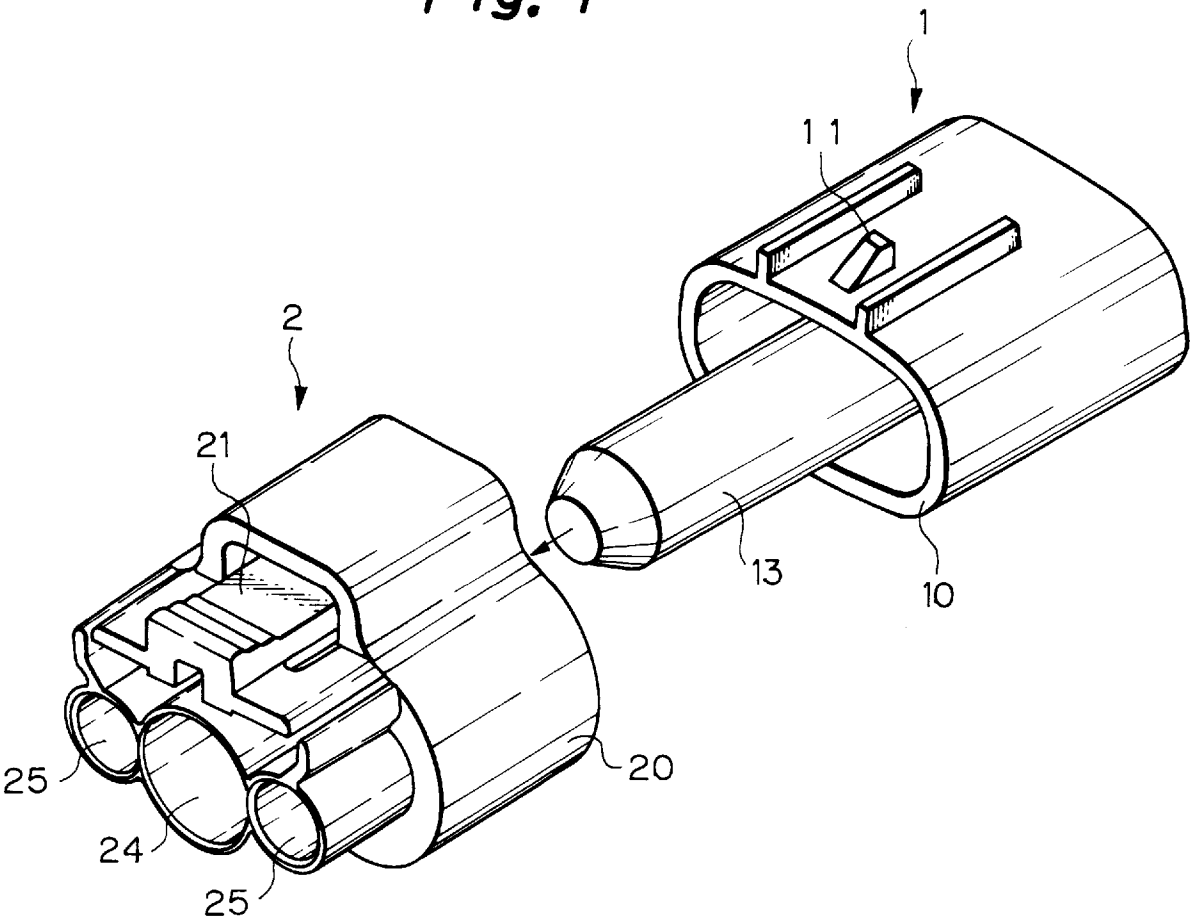
FIG. 1 is an exploded perspective view of a connector assembly of the present invention, illustrating female and male housings in a detached position.

As shown in FIG. 1, the connector assembly comprises a pair of female and male connectors. A male housing 1 of the male connector is provided with a rectangular box like male hood 10. A female housing 2 of the female connector is provided with a box like female hood 20 adapted to receive the male hood 10. When a lock projection 11 formed on an upper face of the male housing 1 engages with a lock shoulder 21*a* (see FIG. 3) formed in a distal end of an arm 21 on an upper portion of the female housing 2, the housings are locked with each other.

Figure 2:
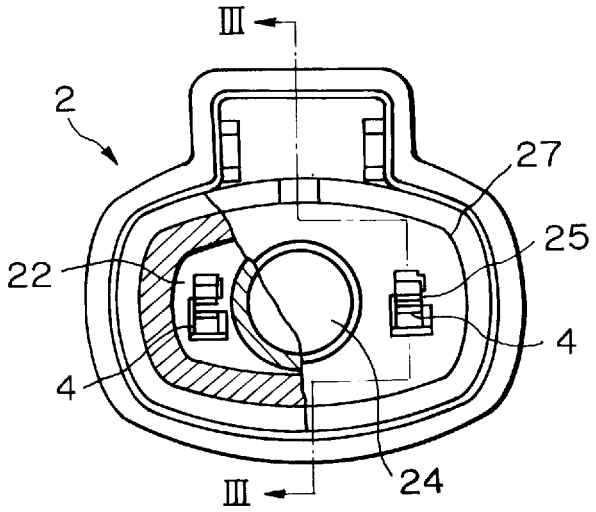
FIG. 2 is a partially broken-away front elevational view of a female connector in a connector assembly of the present invention.
Figure 3:
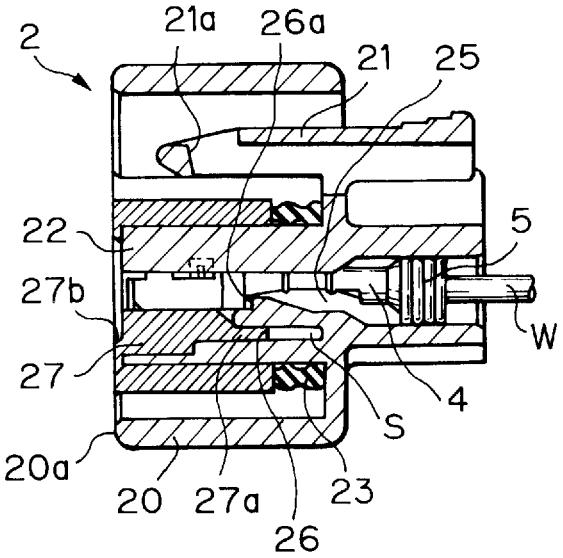
FIG. 3 is a longitudinal sectional view taken along lines III—III in FIG. 2.

As shown in FIGS. 2 and 3, the female housing 2 is provided on a central portion in a coupling direction with a boss 22 on which a retainer 27 described hereinafter is mounted. A waterproofing seal ring 23 is mounted on a proximal end of the box 22. The male hood 10 is adapted to be fitted in a clearance between the boss 22 and the female hood 20 enclosing the boss 22.

The boss 22 is provided on its center with a guide hole 24 extending through the female terminal 2 and on opposite sides of the guide hole 24 with each female terminal accommodating chamber 25 adapted to receive a female terminal 24. As shown in FIG. 3, the chamber 25 is formed at a fitting side into a rectangular cross section suitable for receiving the female terminal and at the other side into a circular cross section suitable for receiving a rubber seal ring 5 through which an electrical wire W passes.

The female terminal accommodating chamber 25 is provided on its middle lower portion with a tongue like lance 26 extending forwardly. The chamber 25 is provided below the lance 26 with a clearance S which allows a distal end of the lance 26 to be deflected up and down in the chamber 25. The lance 26 is provided on its upper end with projections 26*a* adapted to engage with opposite sides of the female terminal 4. Thus, when the female terminal 4 is inserted into the chamber 25 from a rear side of the female housing 2, the female terminal 4 advances in the chamber 25 while the distal end of the terminal 4 deflects the lance 26 downwardly. Then, when the female terminal 4 is completely inserted into the chamber 25, the projections 26*a* on the lance 26 engage with lock apertures (not shown) on opposite sides of the female terminal 4 to bring the female terminal 4 into a primary lock position.

A retainer 27 is formed into a cap like body with a bottom wall and adapted to be mounted on the boss 22. The retainer 27 is fitted onto the boss 22 from its front side and locked on the boss 22 by pawls not shown. The retainer 27 is provided on its bottom wall with a bore corresponding to the guide hole 24. The retainer is also provided on its bottom wall with a tongue 27*a* which extends from the bottom wall into the clearance S to prevent the lance 26 from being deflected. Thus, when the retainer 27 is fitted onto the boss 22 from the front side, the tongue 27*a* enters the clearance S to prevent the lance 26 from being deflected downwardly, thereby bringing the female terminal 4 into a secondary lock position in which it is prevented from coming out of the chamber 25 by accident. The retainer 27 is also provided on its bottom wall in the axial direction of the chamber 25 with an insertion port 27*b* adapted to receive a female terminal 3.

Figure 4:
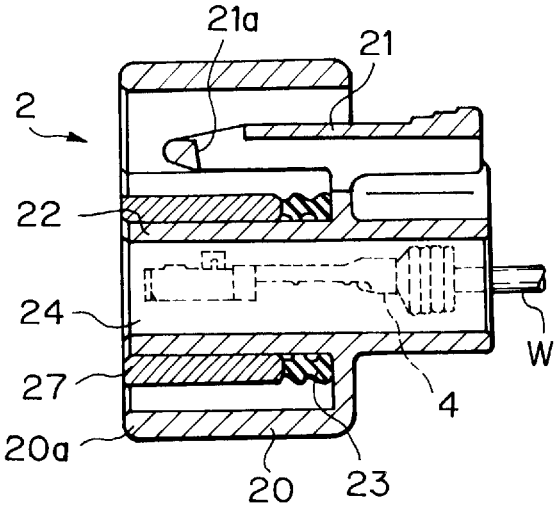
FIG. 4 is a central longitudinal sectional view of a female connector is a connector assembly of the present invention.

As shown in FIG. 4, the guide hole 24 is formed into a circular cross section adapted to introduce a guide rod 13 (described hereinafter) in the male housing 1. The center axis of the guide hole 24 is straight and coincides with the coupling directions of the female and male terminals 4 and 3.

Figure 5:
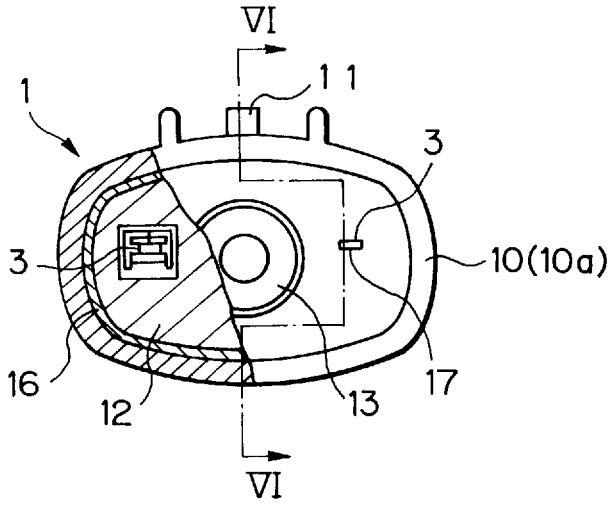
FIG. 5 is a partially broken-away front elevational view of a male connector in a connector assembly of the present invention.
Figure 6:
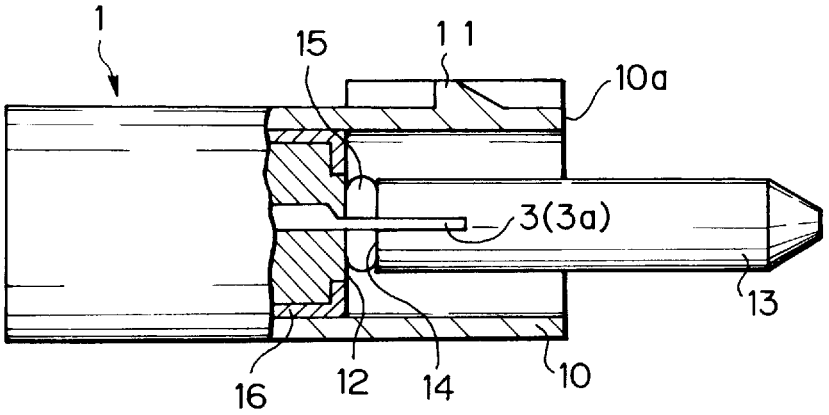
FIG. 6 is a fragmentary longitudinal view taken along lines VI—VI in FIG. 5.
Figure 8:
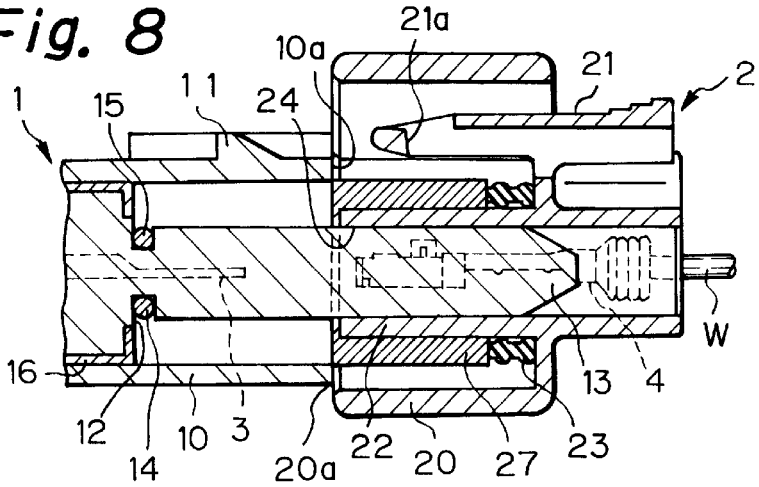
FIG. 8 is a longitudinal sectional view of a part of a connector assembly of the present invention, illustrating hoods of the male and female connectors in their engaging positions.

On the other hand, as shown in FIGS. 5 and 6, a male hood 10 projects from an outer periphery of a joining face 12 to a joining side and is provided on its distal end with a smooth end face 10*a*. The male hood 10 is provided on a center of the joining face 12 with the guide rod 13 which has a circular cross section suitable for entering the guide hole 24 in the female housing 2 and projects outwardly. The guide rod 13 has about two times the length from the joining face 12 to the end face 10*a* of the male hood 10. As shown in FIG. 8, when an end face 20*a* of the female hood 20 contacts with the end face 10*a* of the male hood 10, the guide rod 13 enters the guide hole 24 by more than half its depth. A waterproofing O-ring 15 is mounted in a groove 14 formed in a proximal end of the guide rod 13.

Each male terminal 3 to be fitted to each female terminal 4 is disposed on the right and left sides on the joining face 12. The male terminal 3 is received in a terminal accommodating chamber (not shown) which is formed at the opposite side from the joining face 12 in the male housing 1 and has the same construction as that in the female housing 2. The male terminal 3 is brought into a secondary lock position by a retainer 16. A tab 3*a* at an free end of the male terminal 3 passes through a hole 17 (see FIG. 5) in the retainer 16 and projects in the male hood 10.

When both housings 1 and 2 are coupled to each other so that the lock projection 11 on the upper portion of the male hood 10 engages with the lock shoulder 21*a*, the distal end face of the male hood 10 pushes the seal ring 23 and the distal end face of the guide hole 24 in the female housing 2 pushes the O-ring 15, thereby preventing water from entering interiors of both housings.

Next, an operation of the above embodiment will be explained below.

Figure 7:
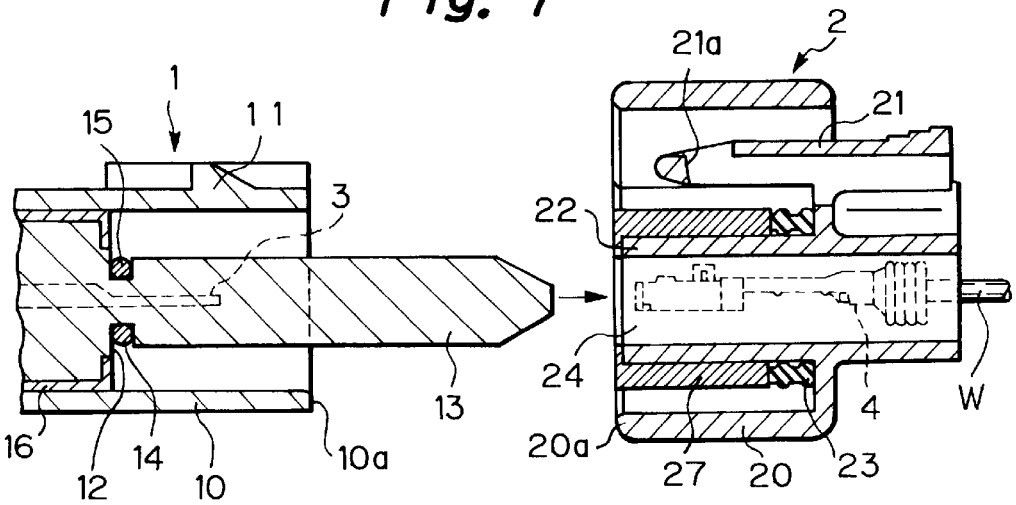
FIG. 7 is an exploded longitudinal sectional view of a part of a connector assembly of the present invention, illustrating the male and female connectors in a position prior to fitting.

As shown in FIG. 7, in order to couple both connectors to each other, the distal end of the guide rod 13 is inserted into the guide hole 24, after the joining sides of both housings 1 and 2 are opposed in an axial direction. Even if the male housing 1 is inserted into the female housing 2 with the housing 1 being inclined with respect to housing 2, the guide rod 13 is introduced by the guide hole 24 while the inclination of the housings 1 and 2 is being corrected. As shown in FIG. 8, the inclination of the housings 1 and 2 is completely corrected and they are opposed to each other before the distal end face 20*a* of the female hood 20 of the female housing 2 engages with the distal end face 10*a* of the male hood 10 of the male housing 1. Thus, even if the male housing 1 is inserted into the female housing 2 with the housing 1 being twisted with respect to the housing 2, both distal end faces 10*a* and 20*a* contact with each other at four points. Consequently, even if they are strongly pressed with each other, they are prevented from being deformed or broken by the inclination of the housings 1 and 2.

Figure 9:
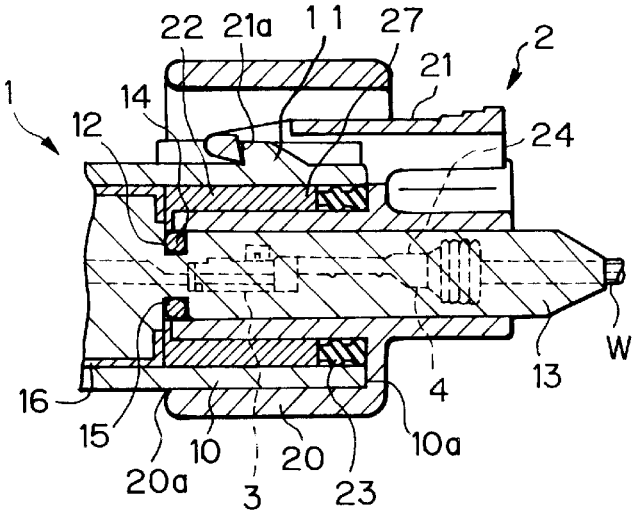
FIG. 9 is a longitudinal sectional view of a part of a connector assembly of the present invention, illustrating the male and female connectors in their coupling position.

At a step of inserting the distal end of the male terminal 3 into the insertion port 27*b*, the guide rod 13 has already been introduced into the guide hole 24. Thus, as shown in FIG. 9, the male and female terminals 3 and 4 are coupled to each other with the coupling direction of the female terminal 4 being restrained in the extending direction of the male terminal 3 and the lock projection 11 engages with the lock shoulder 21*a*. It is possible to prevent the distal end of the male terminal 3 from partially contacting with the opening edge of the insertion port 27*b* or with the coupling aperture in the female terminal 4. Also, the male terminal 3 is not subject to deflection due to the partial contact. Accordingly, the male terminal 3 is not subject to local wear even if coupling and detaching of the connectors are repeated, thereby enhancing reliability of contact.

In the case that the male and female housings 1 and 2 are detached from their coupled state, the engaging arm 21 is pushed down so that the lock pawl 21*a* on the arm 21 is inclined upwardly to release the lock projection 11. When the female housing 2 is drawn from the male housing 1, the guide rod 13 is guided by the guide hole 24 in the same manner as the inserting case of the female housing 2 and the female hood 20 is drawn from the male hood 10 in the coupling direction without causing an interference between them.

In this embodiment, since the guide rod 13 is formed into a circular cross section, the guide rod 13 can be inserted through the guide hole 24, even if the male housing 1 is inserted into the female housing 2 with the housing 1 being twisted. Even if the coupling work cannot be visualized, it can be easily carried out.

Although the above embodiment is applied to a connector assembly in which the male and female terminals 3 and 4 are received in the chambers in the male and female housings 1 and 2, it may be applied to a connector assembly in which each terminal is press-inserted in the housing. The present invention may have the following embodiments.

Figure 10:
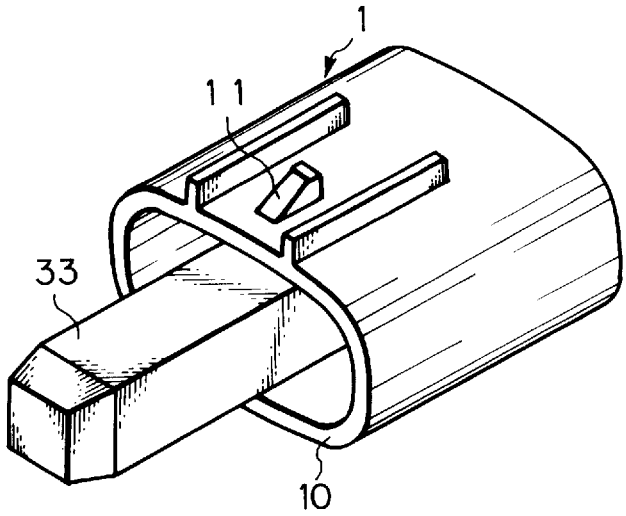
FIG. 10 is a perspective view of another embodiment of a male connector in a connector assembly of the present invention.
Figure 11:
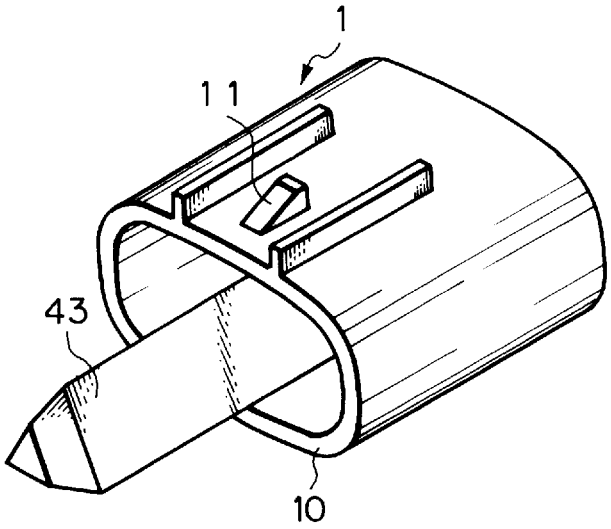
FIG. 11 is a perspective view of still another embodiment of a male connector in a connector assembly of the present invention.
Figure 12:
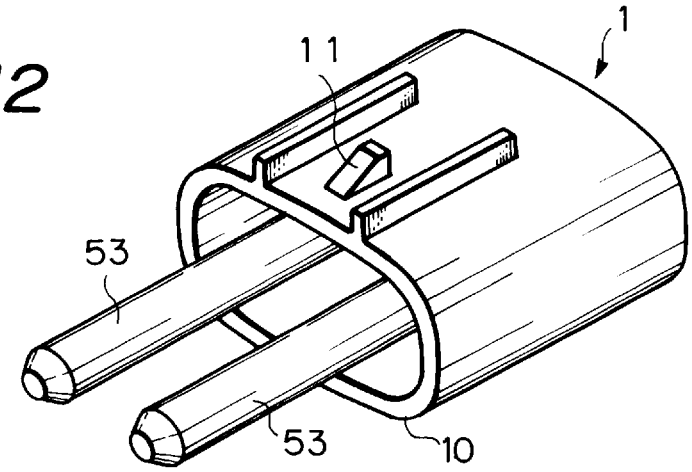
FIG. 12 is a perspective view of still another embodiment of a male connector in a connector assembly of the present invention.
Figure 13:
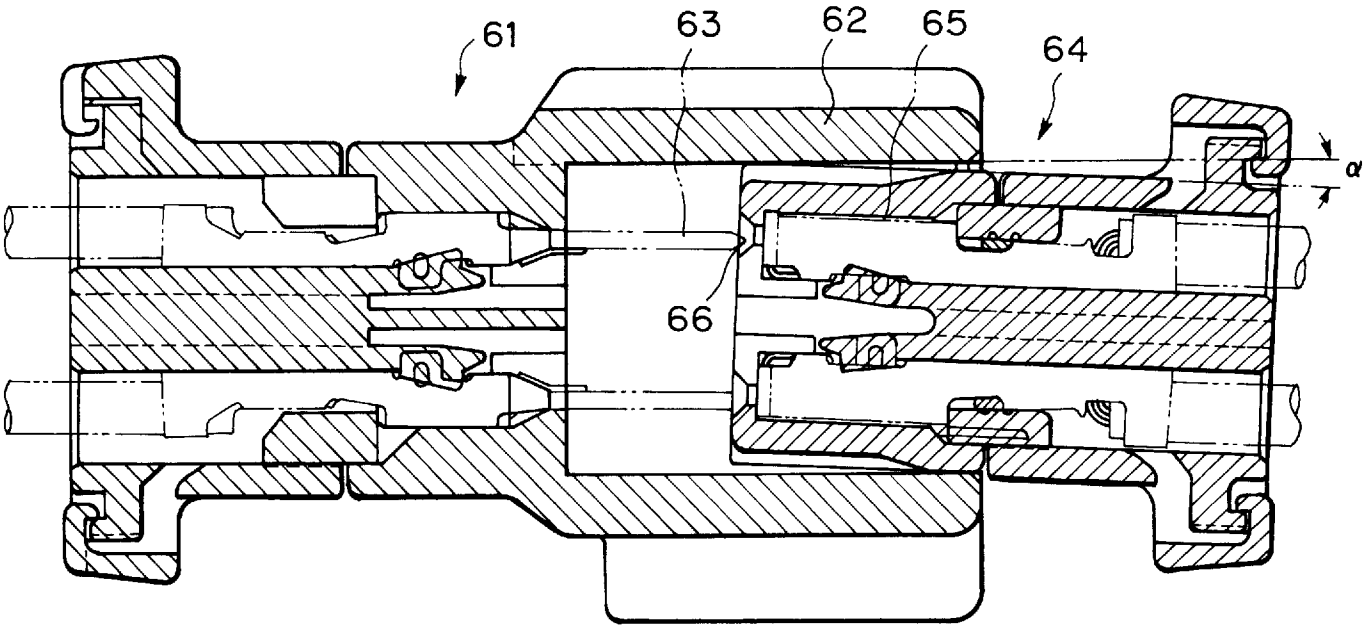
Fig. 13 PRIOR ART
FIG. 13 is a longitudinal sectional view of a conventional connector assembly, illustrating the assembly in a failed coupling state.

(1) Although the guide rod 13 is formed into a circular cross section in the above embodiment, the guide rod 13 may be formed into a polygonal cross section such as a rectangular cross section (33) shown in FIG. 10, or a triangular cross section (43) shown in FIG. 11. If the guide rod 13 is inserted through the guide hole 24 in the embodiments shown in FIGS. 10 to 12, both housings are constrained in the twisting direction. The distal end faces of the male and female hoods do not strike each other, thereby causing no breakage of the hoods. Accordingly, it is sufficient to restrict only insertion direction when the distal end of the male terminal engages with the female housing and it is possible to shorten the guide rod.

Further, it is possible to provide the guide rod on an exterior of the male housing not shown. This case can be applied to a multi-pole connector assembly, since the number of terminals to be coupled can be increased.

(2) Although the above embodiment is applied to a waterproof connector assembly, the connector of the present invention should not be limited to it.

(3) Although the guide rod 13 is inserted into the guide hole 24 to constrain the coupling direction in the above embodiment, the guide hole may be means for constraining the coupling direction of the guide rod such as rail-like guides.

What is claimed is:

1. A connector assembly comprising a male connector and a female connector, said male connector having at least one projecting male terminal and a male hood surrounding said terminal, said female connector having at least one female terminal complementary to said male terminal and interconnected therewith, a guide rod projecting from one of said male connector and said female connector and having a distal end remote therefrom, a guide complementary to said guide rod, in another of said male connector and said female connector, said other connector having a rearmost face facing away from said one connector, said distal end extending through said other connector and projecting beyond said face.

2. The assembly of claim 1 wherein said guide is circular in cross section.

3. The assembly of claim 1 wherein said guide is polygonal in cross section.

4. The assembly of claim 1 wherein said male hood surrounds a front portion of said female connector.

5. The assembly of claim 1 wherein there is a plurality of said guide rods and said guides.

* * * * *